US006806788B1

(12) United States Patent
Marumoto

(10) Patent No.: US 6,806,788 B1
(45) Date of Patent: Oct. 19, 2004

(54) MICROMACHINE SWITCH

(75) Inventor: Tsunehisa Marumoto, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/958,018

(22) PCT Filed: Jan. 28, 2000

(86) PCT No.: PCT/JP00/00465

§ 371 (c)(1),
(2), (4) Date: Jan. 28, 2002

(87) PCT Pub. No.: WO00/60627

PCT Pub. Date: Oct. 12, 2000

(30) Foreign Application Priority Data

Apr. 2, 1999 (JP) ..... 11/096949

(51) Int. Cl.[7] ..... H01P 1/10

(52) U.S. Cl. ..... 333/101; 333/259; 333/262; 200/181

(58) Field of Search ..... 333/101, 105, 333/262, 259; 200/181

(56) References Cited

U.S. PATENT DOCUMENTS 5,296,825 A 3/1994 Tsuruoka ..... 333/246
5,578,976 A 11/1996 Yao
6,359,529 B1 * 3/2002 Tsunoda et al. ..... 333/101
6,417,807 B1 * 7/2002 Hsu et al. ..... 343/700 MS
6,433,657 B1 * 8/2002 Chen ..... 333/262
6,489,857 B2 * 12/2002 Petrarca et al. ..... 333/105

FOREIGN PATENT DOCUMENTS

| | | |
|---|---|---|
| DE | 40 08 832 | 7/1991 |
| EP | 0 521 739 | 1/1993 |
| EP | 0 706 702 | 4/1996 |
| JP | 2000-113792 | 4/2000 |
| WO | 98/21734 | 5/1998 |

* cited by examiner

*Primary Examiner*—Benny T. Lee
*Assistant Examiner*—Kimberly Glenn
(74) *Attorney, Agent, or Firm*—Young & Thompson

(57) ABSTRACT

A micromachine switch includes a driving part (12) for displacing a contact (11) on the basis of a control signal, a first control signal line (4) for applying the control signal to the driving part, and a first RF signal inhibiting part (3) connected to the first control signal line to inhibit, from passing therethrough, an RF signal flowing RF signal lines (1*a*, 1*b*). With this arrangement, an insertion loss of the micromachine switch can be reduced, and the RF characteristic of a circuit using the micromachine switch can be improved.

33 Claims, 12 Drawing Sheets

MICROMACHINE SWITCH

TECHNICAL FIELD

The present invention relates to a micromachine switch used in a milliwave circuit and microwave circuit.

BACKGROUND ART

Switch devices such as a PIN diode switch, HEMT switch, micromachine switch, and the like are used in a milliwave circuit and microwave circuit. Of these switches, the micromachine switch is characterized in that the loss is smaller than that of the other devices, and the cost and power consumption are low.

FIG. 16 is a block diagram showing the overall arrangement of a conventional micromachine switch. FIG. 17 is a perspective view showing the arrangement of a switch main body in FIG. 16.

As shown in FIG. 17, RF signal lines 101*a* and 101*b* are formed on a substrate 110 at a small gap.

A contact 111 is supported by a support means 113 above the gap between the RF signal lines 101*a* and 101*b* so as to freely contact the RF signal lines 101*a* and 101*b*.

The support means 113 is constituted by a post 113*a* and two arms 113*b*. The post 113*a* is formed on the substrate 110 to be spaced apart from the RF signal lines 101*a* and 101*b*. The two arms 113*b* extend from the upper portion of the side surface of the post 113*a*, and the contact 111 is attached to the distal ends of the arms 113*b*.

A control electrode 112 is formed at the gap between the RF signal lines 101*a* and 101*b* on the substrate 110, i.e., at a position immediately under the contact 111. The thickness of the control electrode 112 is smaller than that of each of the RF signal lines 101*a* and 101*b*.

A control signal line 104 which is connected to a controller 105 is connected to the control electrode 112. The controller 105 outputs a control signal for switching the connection states of the RF signal lines 101*a* and 101*b*. Therefore, a control signal output from the controller 105 is applied to the control electrode 112 through the control signal line 104.

The operation of this micromachine switch will be described next.

When a voltage is applied to the control electrode 112 as a control signal, e.g., when a positive voltage is applied, positive charges appear on the surface of the control electrode 112, and negative charges appear on the lower surface of the contact 111 opposing the control electrode 112 by electrostatic induction. The contact 111 is attracted toward the RF signal lines 101*a* and 101*b* by an attraction force between the control electrode 112 and contact 111.

At this time, since the length of the contact 111 is larger than the gap between the RF signal lines 101*a* and 101*b*, the contact 111 is brought into contact with both the RF signal lines 101*a* and 101*b*, and the RF signal lines 101*a* and 101*b* are connected to each other through the contact 111 in a high-frequency manner.

When stopping applying the positive voltage to the control electrode 112, since the attraction force disappears, the contact 111 returns to the home position by a restoring force of the arms 113*b*. Thus, the RF signal lines 101*a* and 101*b* are released.

In the conventional micromachine switch shown in FIG. 16, however, an RF signal RF flowing when the RF signal lines 101*a* and 101*b* are kept connected may leak out into the control signal line 104 through the control electrode 112.

If an RF signal RF leaks out, an insertion loss increases by the leakage signal. In addition, the leakage power may be coupled to another RF signal line depending on the shape of the control signal line 104. This adversely affects the characteristics of the entire circuit and causes resonance.

The present invention has been made to solve the above problem, and has as its object to reduce the insertion loss of a micromachine switch.

It is another object to improve the RF characteristic of a circuit using a micromachine switch.

DISCLOSURE OF INVENTION

In order to achieve the above objects, according to the present invention, a micromachine switch is characterized by comprising driving means for displacing a contact on the basis of a control signal, a first control signal line for apply ng the control signal to the driving means, and a first RF signal inhibiting means connected to the first control signal line to inhibit, from passing therethrough, an RF signal flowing into RF signal lines.

In this case, in the first arrangement, the first RF signal inhibiting means is constituted by a high-impedance line having one end connected to the driving means, a line length of about ¼ a wavelength of the RF signal, and a characteristic impedance higher than a characteristic impedance of each of the RF signal lines, and a low-impedance line having one end connected to the other end of the high-impedance line, the other end which is open, a line length of about ¼ the wavelength of the RF signal, and a characteristic impedance lower than the characteristic impedance of the high-impedance line, and the first control signal line is connected to the other end of the high-impedance line.

In the second arrangement, the first RF signal inhibiting means is constituted by a high-impedance line having one end connected to the driving means, a line length of about ¼ a wavelength of the RF signal, and a characteristic impedance higher than a characteristic impedance of each of the RF signal lines, and a capacitor having one electrode connected to the other end of the high-impedance line and the other electrode connected to ground, and the first control signal line is connected to the other end of the high-impedance line.

In the third arrangement, the first RF signal inhibiting means comprises an inductance element. The inductance element may be a spiral inductor or meander line inductor.

In the fourth arrangement, the first RF signal inhibiting means comprises a resistive element having an impedance much higher than a characteristic impedance of each of the RF signal lines.

At this time, the resistive element may be serially inserted into the first control signal line. Alternatively, one terminal of the resistive element may be connected to the first control signal line, and the other terminal may be open.

As described above, the first RF signal inhibiting means for inhibiting, from passing therethrough, the RF signal flowing into the RF signal lines is connected to the first control signal line, thus preventing the RF signal from leaking out from the RF signal lines into the first control signal line. Accordingly, an insertion loss of the micromachine switch can be reduced. Also, since electromagnetic coupling from the first control signal line to another control signal line can be prevented, the RF characteristic of a circuit using a micromachine switch can be improved.

According to the present invention, a micromachine switch is characterized by comprising support means for supporting a contact, driving means for displacing the contact on the basis of a control signal, a first control signal line for applying the control signal to the driving means, and a first RF signal inhibiting means connected to the first control signal line to inhibit, from passing therethrough, an RF signal flowing into the RF signal lines.

In this case, in an arrangement, the driving means comprises a control electrode arranged immediately under the contact between the RF signal lines.

At this time, the support means has conductivity, and the switch may further comprise a second control signal line for storing, through the support means, charges which appear on the contact by electrostatic induction upon starting applying the control signal to the control electrode, and removing the charges from the contact through the support means upon stopping applying the control signal to the control electrode, and second RF signal inhibiting means connected to the second control signal line to inhibit, from passing therethrough, an RF signal flowing into the RF signal lines.

In another arrangement, the driving means comprises a lower electrode arranged at a position spaced apart from each of the RF signal lines and a gap between the RF signal lines, and an upper electrode attached on the support means so as to oppose the lower electrode apart from each other.

In this case, the control signal may be applied to the lower electrode.

At this time, the support means has an insulating portion between the upper electrode and contact, and the switch may further comprise a second control signal line for storing, through the support means, charges which appear on the upper electrode by electrostatic induction upon starting applying the control signal to the lower electrode, and removing the charges from the upper electrode through the support means upon stopping applying the control signal to the lower electrode, and:second RF signal inhibiting means connected to the second control signal line to inhibit, from passing therethrough, the RF signal flowing into the RF signal lines.

In the first arrangement, the second RF signal inhibiting means is constituted by a high-impedance line having one end connected to the support means, a line length of about ¼ a wavelength of the RF signal, and a characteristic impedance higher than a characteristic impedance of each of the RF signal lines, and a low-impedance line having one end connected to the other end of the high-impedance line, the other end which is open, a line length of about ¼ the wavelength of the RF signal, and a characteristic impedance lower than the characteristic impedance of the high-impedance line, and the second control signal line is connected to the other end of the high-impedance line.

In the second arrangement, the second RF signal inhibiting means is constituted by a high-impedance line having one end connected to the support means, a line length of about ¼ a wavelength of the RF signal, and a characteristic impedance higher than a characteristic impedance of each of the RF signal lines, and a capacitor having one electrode connected to the other end of the high-impedance line and the other electrode connected to ground, and the second control signal line is connected to the other end of the high-impedance line.

The first and second RF signal inhibiting means may be constituted by a first high-impedance line having one end connected to the driving means, a line length of about ¼ a wavelength of the RF signal, and a characteristic impedance higher than a characteristic impedance of each of the RF signal lines, a second high-impedance line having one end connected to the support means, a line length of about ¼ the wavelength of the RF signal, and a characteristic impedance higher than a characteristic impedance of each of the RF signal lines, and a capacitor having one electrode connected to the other end of the first high-impedance line and the other electrode connected to the other end of the second high-impedance line, the other end of the first high-impedance line may be connected to the first control signal line, and the other end of the second high-impedance line may be connected to ground.

In the third arrangement, the second RF signal inhibiting means comprises an inductance element. The inductance element may be a spiral inductor or meander line inductor.

In the fourth arrangement, the second RF signal inhibiting means comprises a resistive element having an impedance much higher than a characteristic impedance of each of the RF signal lines.

At this time, the resistive element may be serially inserted into the second control signal line. Alternatively, one terminal of the resistive element may be connected to the second control signal line, and the other terminal may be open.

Further, in the micromachine switch described above, the support means has an insulating portion between the upper electrode and contact, and the control signal may be applied to the upper electrode.

In this case, the switch may comprise a second control signal line for storing charges which appear on the lower electrode by electrostatic induction upon starting applying the control signal to the upper electrode, and removing the charges from the lower electrode upon stopping applying the control signal to the upper electrode, and second RF signal inhibiting means connected to the second control signal line to inhibit, from passing therethrough, an RF signal flowing into the RF signal lines.

As described above, the charges are stored to/removed from the contact, the upper electrode, or the lower electrode through the second control signal line. This stabilizes switching operation and increases a switching speed. At this time, the second RF signal inhibiting means for inhibiting, from passing therethrough, the RF signal flowing into the RF signal lines is connected to the second control signal line, thus preventing the RF signal from leaking out from the RF signal lines into the second control signal line. Therefore, any problem due to an increase in insertion loss and the degradation of RF characteristic is not posed.

According to the present invention, a micromachine switch is characterized by comprising a control electrode arranged immediately under a contact between RF signal lines to displace the contact on the basis of a control signal, a first control signal line for applying the control signal to the control electrode, and first RF signal inhibiting means connected to the first control signal line to inhibit, from passing therethrough, an RF signal flowing into the RF signal lines, wherein the contact extends from an end portion of one of the RF signal lines to a space above the other of the RF signal lines.

In this case, the switch may comprise a second control signal line for storing, through one of the RF signal lines, charges which appear on the contact by electrostatic induction upon starting applying the control signal to the control electrode, and removing the charges from the contact through one of the RF signal lines upon stopping applying the control signal to the control electrode, and second RF signal inhibiting means connected to the second control signal line to inhibit, from passing therethrough, an RF signal flowing into the RF signal lines.

In the first arrangement, the second RF signal inhibiting means is constituted by a high-impedance line having one end connected to one of the RF signal lines, a line length of about ¼ a wavelength of the RF signal, and a characteristic impedance higher than a characteristic impedance of each of the RF signal lines, and a low-impedance line having one end connected to the other end of the high-impedance line, the other end which is open, a line length of about ¼ the wavelength of the RF signal, and a characteristic impedance lower than the characteristic impedance of the high-impedance line, and the second control signal line is connected to the other end of the high-impedance line.

In the second arrangement, the second RF signal inhibiting means is constituted by a high-impedance line having ore end connected to one of the RF signal lines, a line length of about ¼ a wavelength of the RF signal, and a characteristic impedance higher than a characteristic impedance of each of the RF signal lines, and a capacitor having one electrode connected to the other end of the high-impedance line and the other electrode connected to ground, and the second control signal line is connected to the other end of the high-impedance line.

The first and second RF signal inhibiting means may be constituted by a first high-impedance line having one end connected to the driving means, a line length of about ¼ a wavelength of the RF signal, and a characteristic impedance higher than a characteristic impedance of each of;the RF signal lines, a second high-impedance line having one end connected to one of the RF signal lines, a line length of about ¼ the wavelength of the RF signal, and a characteristic impedance higher than a characteristic impedance of each of the RF signal lines, and a capacitor having one electrode connected to the other end of the first high-impedance line and the other electrode connected to the other end of the second high-impedance line, the other end of the first high-impedance line may be connected to the first control signal line, and the other end of the second high-impedance line may be connected to ground.

In the third arrangement, the second RF signal inhibiting means comprises an inductance element. The inductance element may be a spiral inductor or meander line inductor.

In the fourth arrangement, the second RF signal inhibiting means comprises a resistive element having an impedance much higher than a characteristic impedance of each of the RF signal lines.

At this time, the resistive element may be serially inserted into the second control signal line. Alternatively, one terminal of the resistive element may be connected to the second control signal line, and the other terminal is open.

As described above, the second control signal line is connected to one of the RF signal lines to which the contact is fixed, and the charges are stored/removed through the second control signal line, thereby stabilizing switching operation and increasing a switching speed. At this time, the second RF signal inhibiting means for inhibiting, from passing therethrough, the RF signal flowing into the RF signal lines is connected to the second control signal line, thus preventing the RF signal from leaking out from the RF signal lines into the second control signal line. Therefore, any problem due to an increase in insertion loss and the degradation of RF characteristic is not posed.

BEST MODE OF CARRYING OUT THE INVENTION

Embodiments of the present invention will be described in detail below with reference to the accompanying drawings. A micromachine switch to be described here is a microswitch suitable for integration by a semiconductor device manufacturing process.

First Embodiment

Figure 1:
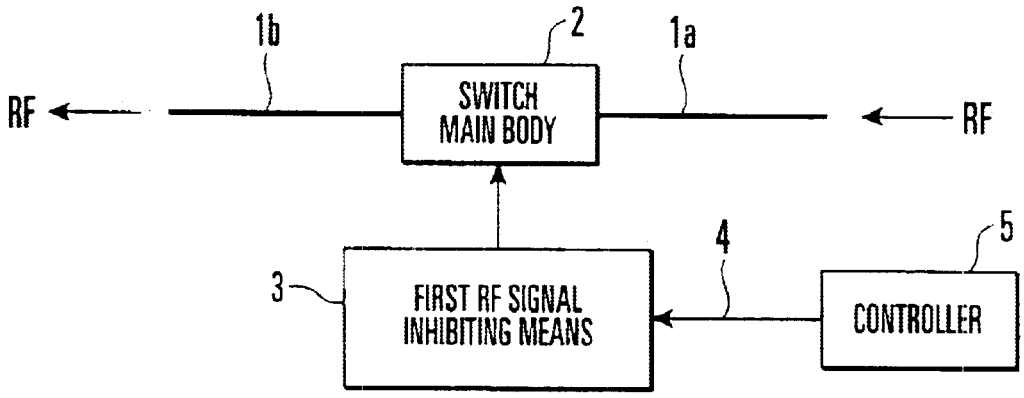
FIG. 1 is a block diagram showing the overall arrangement of a micromachine switch according to the first embodiment of the present invention.
Figure 2:
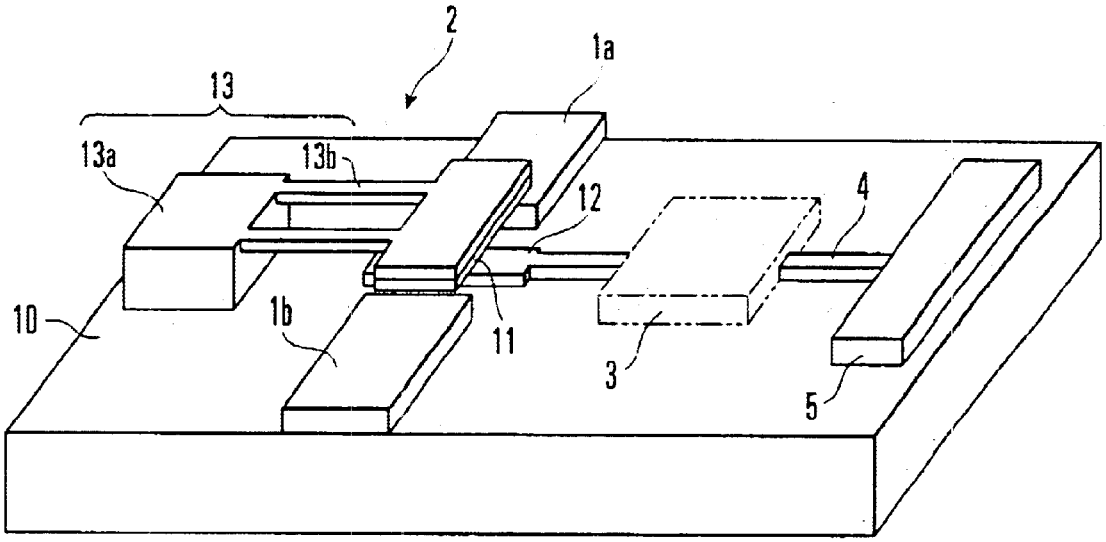
FIG. 2 is a perspective view of the first arrangement of a switch main body.

FIG. 1 is a block diagram showing the overall arrangement of a micromachine switch according to the first embodiment of the present invention. FIG. 2 is a perspective view showing the first arrangement of a switch main body in FIG. 1.

As shown in FIG. 2, RF signal lines 1*a* and 1*b* are formed on a substrate 10 at a small gap.

A contact 11 is supported by a support means 13 above the gap between the RF signal lines 1*a* and 1*b* so as to freely contact the RF signal lines 1*a* and 1*b*.

The support means 13 is constituted by a post 13*a* and arm 13*b*. The post 13*a* is formed on the substrate 10 to be spaced apart from the RF signal lines 1*a* and 1*b*. The arm 13*b* extends from the upper portion of the side surface of the post 13*a* to the space above the gap between the RF signal lines 1*a* and 1*b*. The contact 11 is attached to the lower surface of the distal end portion of the arm 13*b*.

A control electrode 12 is formed at the gap between the RF signal lines 1*a* and 1*b* on the substrate 10, i.e., at a position immediately under the contact 11. The thickness of the control electrode 12 is smaller than that of each of the RF signal lines 1*a* and 1*b*.

A switch main body 2 shown in FIG. 2 is constituted by the contact 11, support means 13, and control electrode 12.

Note that an insulating film (not shown) may be formed on the lower surface of the contact 11.

A first control signal line 4 which is connected to a controller 5 is connected to the control electrode 12 through a first RF signal inhibiting means 3.

The controller 5 outputs a control signal for switching the connection states of the RF signal lines 1*a* and 1*b*.

The first RF signal inhibiting means 3 inhibits, from passing therethrough, an RF signal RF which flows while the RF signal lines 1*a* and 1*b* are connected to each other.

Therefore, a control signal output from the controller 5 is applied to the control electrode 12 through the control signal line 4 and first RF signal inhibiting means 3. As will be described later, since the displacement of the contact 11 is controlled depending on whether a voltage is applied to the control electrode 12, the control electrode 12 has a function as a driving means for the contact 11.

The operation of this micromachine switch will be described next.

When a voltage is applied to the control electrode 12 as a control signal, e.g., when a positive voltage is applied, positive charges appear on the upper surface of the control electrode 12, and negative charges appear on the lower surface of the contact 11 opposing the control electrode 12 by electrostatic induction. The contact 11 is attracted toward the side of the RF signal lines 1*a* and 1*b* by an attraction force generated between the control electrode 12 and contact 11.

Since the length of the contact 11 is larger than the gap between the RF signal lines 1*a* and 1*b*, the contact 11 is brought into contact with both the RF signal lines 1*a* and 1*b*, and the RF signal lines 1*a* and 1*b* are connected to each other through the contact 11 in a high-frequency manner.

At this time, although an RF signal RF flows from the RF signal line 1*a* to RF signal line 1*b*, the first RF signal inhibiting means 3 inhibits the RF signal RF from flowing into the first control signal line 4.

On this other hand, when stopping applying the positive voltage to the control electrode 12, since the attraction force disappears, the contact 11 returns to the home position by a restoring force of the arm 13*b*. Thus, the RF signal lines 1*a* and 1*b* are released.

The arrangements of the first RF signal inhibiting means 3 shown in FIG. 1 will be described with reference to FIGS. 3A and 3B to 7A and 7B.

Figure 3A:
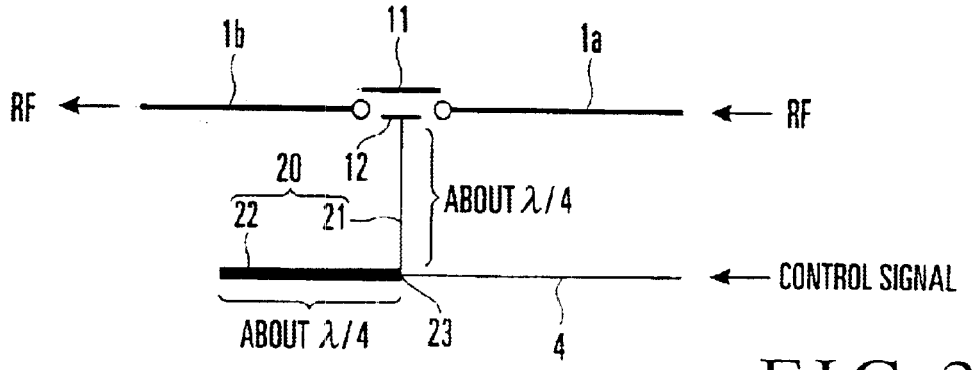
FIG. 3A is a circuit diagram of the first arrangement of a first RF signal inhibiting means.
Figure 3B:
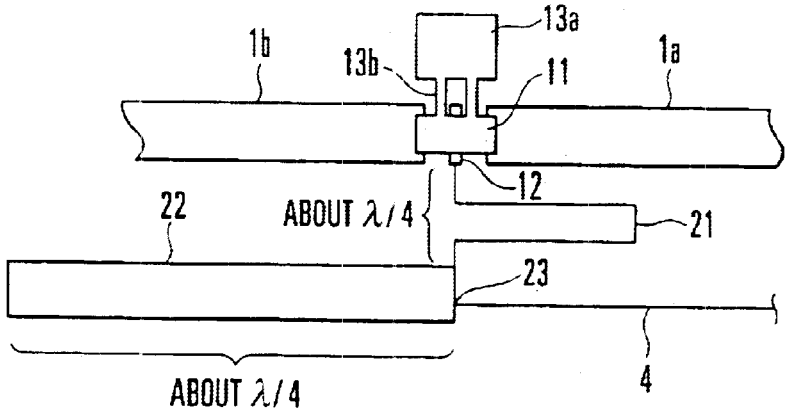
FIG. 3B is a plan view of the first arrangement.

The first arrangement of the first RF signal inhibiting means 3 will be described first. FIG. 3A is a circuit diagram of the first arrangement of the first RF signal inhibiting means 3, and FIG. 3B is a plan view of the first arrangement.

In the first arrangement, the first RF signal inhibiting means 3 is a filter 30 constituted by a high-impedance λ/4 line 21 and low-impedance λ/4 line 22.

The high-impedance λ/4 line 21 has a line length of about λ/4 (λ is the wavelength of an RF signal RF) and a characteristic impedance higher than that of each of the RF signal lines 1*a* and 1*b*. The low-impedance λ/4 line 22 has a line length of about λ/4 and a characteristic impedance lower than that of each of the RF signal lines 1*a* and 1*b*.

The characteristic impedance value of each of the lines 21 and 22 depends on the characteristic impedance of each of the RF signal lines 1*a* and 1*b*. For example, if the characteristic impedance of each of the RF signal lines 1*a* and 1*b* is a general value of 50Ω, the characteristic impedance of the high-impedance λ/4 line 21 is preferably set about almost 70 to 200Ω (i.e., a value 1.4 to 4 times the characteristic impedance of each of the RF signal lines 1*a* and 1*b*), and the characteristic impedance of the low-impedance λ/4 line 22 is preferably set about almost 20 to 40Ω (i.e., a value 0.4 to 0.8 times the characteristic impedance of each of the RF signal lines 1*a* and 1*b*).

One end of the high-impedance λ/4 line 21 is connected to the control electrode 12, and the other end is connected to one end of the low-impedance λ/4 line 22. The other end of the low-impedance ¼ line 22 is open. The other end of the high-impedance λ/4 line 21 (i.e., a connecting point 23 of the lines 21 and 22) is further connected to the first control signal line 4 with a high impedance.

The operation principle of the filter 20 will be briefly described next.

As described above, since the other end of the low-impedance λ/4 line 22 is open, the impedance of the low-impedance λ/4 line 22 is 0Ω when viewed from the connecting point 23 spaced apart from the other end of the low-impedance λ/4 line 22 by λ/4. This is equivalent to a state in which the low-impedance λ/4 line 22 is grounded at the connecting point 23 in a high-frequency manner. Therefore, even when the first control signal line 4 is parallelly connected to the connecting point 23, the impedance at the connecting point 23 is kept at 0Ω and has no influence on RF behavior.

Since the control electrode 12 is connected to the connecting point 23 through the high-impedance λ/4 line 22 with the line length of λ/4, the impedance of the filter 20 is infinite (∞ Ω) when viewed from the control electrode 12. Accordingly, no RF flows from the control electrode 12 to the filter 20, and in a high-frequency manner, this is equivalent to an RF state in which the filter 20 and the first control signal line 4 are absent.

The arrangement of the filter 20 described above is generally called a bias-T. Since this filter eliminates only a specific frequency band, it operates as a kind of band elimination filter.

Figure 4A:
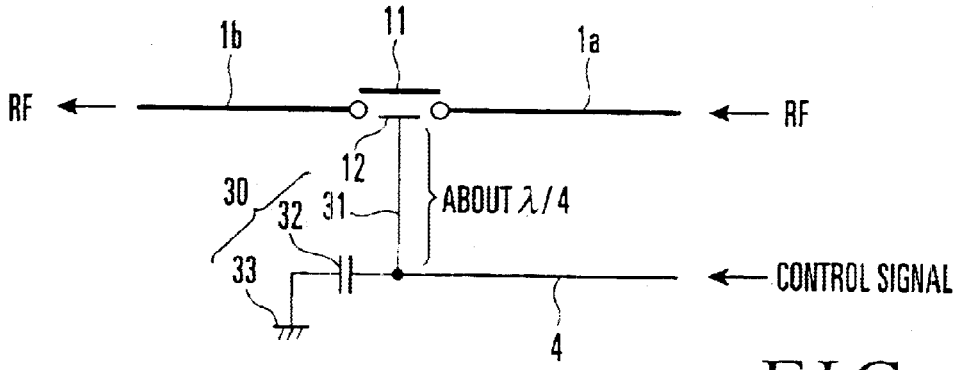
FIG. 4A is a circuit diagram of the second arrangement of the first RF signal inhibiting means.

The second arrangement of the first RF signal inhibiting means 3 will be described next. FIG. 4A is a circuit diagram of the second arrangement of the first RF signal inhibiting means 3, and FIG. 4B is a plan view of the second arrangement.

In the second arrangement, the first RF signal inhibiting means 3 comprises a filter 30 constituted by a high-impedance λ/4 line 31, capacitor 32, and ground 33.

As shown in FIG. 4A, one end of the high-impedance λ/4 line 31 is connected to the control electrode 12, and the other end is connected to one electrode of the capacitor 32. The other electrode of the capacitor 32 is connected to the ground 33. One electrode of the capacitor 32 which is connected to the high-impedance λ/4 line 31 is further connected to the first control signal line 4.

Figure 4B:
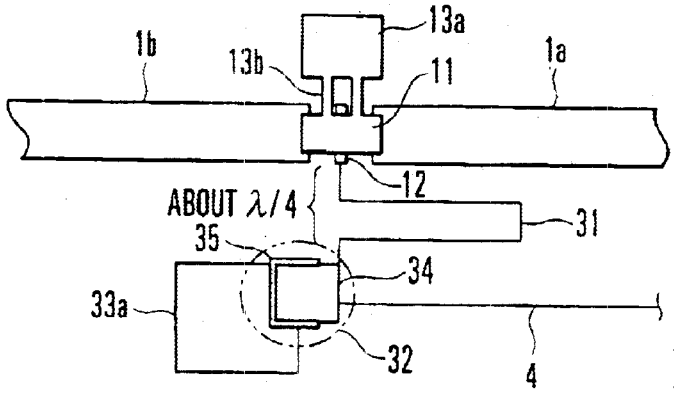
FIG. 4B is a plan view of the second arrangement.

As shown in FIG. 4B, the capacitor 32 includes an electrode 34 serving as one electrode of the capacitor 32, a ground electrode 33*a* serving as the other electrode of the capacitor 32, and an insulating film 35 interposed between the electrodes 34 and 33*a*.

The high-impedance λ/4 line 31 has a line length of about λ/4 and a characteristic impedance higher than that of each of the RF signal lines 1*a* and 1*b*. The optimum value of the characteristic impedance of the high-impedance λ/4 line 31 is determined in the same manner as the high-impedance λ/4 line 21 shown in FIGS. 3A and 3B.

The operation principle of the filter 30 will be briefly described next.

The capacitor 32 has a sufficient capacitance, and, the connecting point of the high-impedance λ/4 line 31 and capacitor 32 is equivalent to that grounded in a high-frequency manner, so that the impedance of the connecting point is 0Ω. Therefore, similar to the case shown in FIGS. 3A and 3B, even when the first control signal line 4 is further connected to the connecting point, the impedance has no influence in a high-frequency manner.

Since the control electrode 12 is connected to the capacitor 32 through the high-impedance λ/4 line 31 with the line length of λ/4, the impedance of the filter 30 is infinite (∞ Ω) when viewed from the control electrode 12, i.e., no RF signal RF flows from the control electrode 12 into the filter 30.

The filter 30 described above is also a kind of bias-T and operates as a band elimination filter.

Figure 5A:
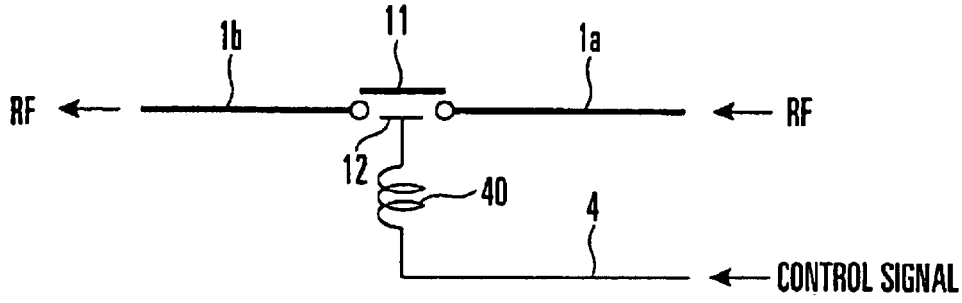
FIG. 5A is a circuit diagram of the third arrangement of the first RF signal inhibiting means.
Figure 5B:
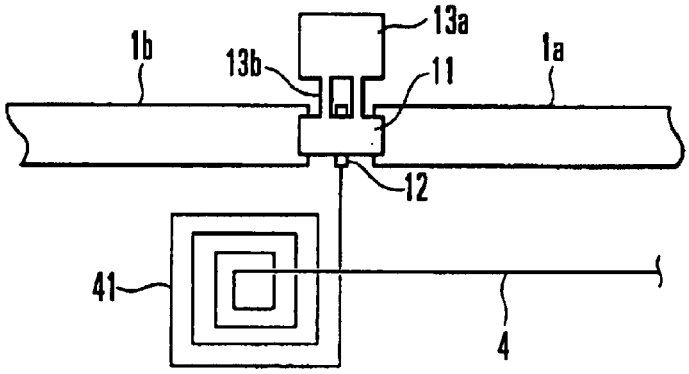
FIG. 5B and 5C are is a plan view of the third arrangement.
Figure 5C:
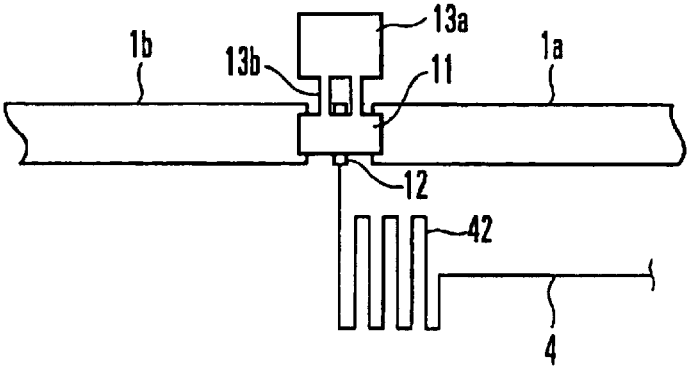

The third arrangement of the first RF signal inhibiting means 3 will be described. FIG. 5A is a circuit diagram of the third arrangement of the first RF signal inhibiting means 3, and FIGS. 5B and 5C are plan views of the third arrangement.

As shown in FIG. 5A, a filter 40 comprised of an inductance element can be used as the first RF signal inhibiting means 3. More specifically, a spiral inductor 41 shown in FIG. 5B, a meander line inductor 42 shown in FIG. 5C, or the like can be used.

Since each of these inductive circuit elements has a low impedance for a direct current and low frequency but has a high impedance for a high frequency, it operates as a low-pass filter. However, only a cutoff frequency is set lower than the frequency of the RF signal RF.

Not only such a distributed constant element but also a lumped constant element such as a coil may be used by attaching it to the circuit.

Note that as a low-pass filter, another filter such as a filter arranged by vertically cascade-connecting lines having different characteristic impedances can also be used.

Figure 6A:
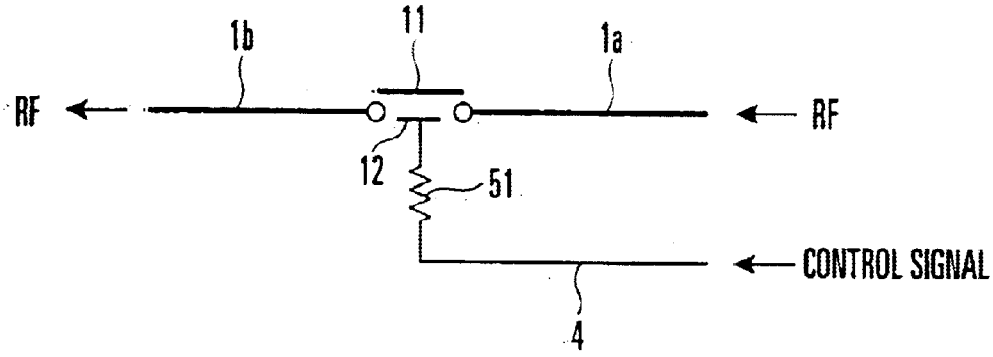
FIG. 6A is a circuit diagram of the fourth arrangement of the first RF signal inhibiting means.
Figure 6B:
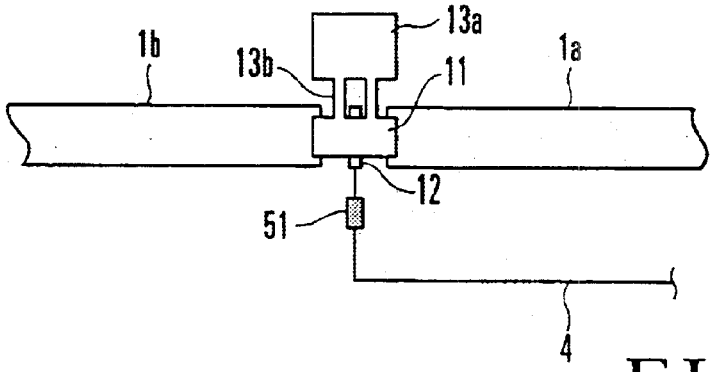
FIG. 6B is a plan view of the fourth arrangement.

The fourth arrangement of the first RF signal inhibiting means 3 will be described. FIG. 6A is a circuit diagram of the fourth arrangement of the first RF signal inhibiting means 3, and FIG. 6B is a plan view of the fourth arrangement.

As shown in FIG. 6A, a resistive element 51 is serially inserted in the first control signal line 4 as the first RF signal inhibiting means 3, thus inhibiting an RF signal RF from flowing into the first control signal line 4.

The resistive element 51 may have an impedance value twice or more the characteristic impedance of the each of the RF signal lines 1*a* and 1*b* and is preferably set to have an impedance value about 20 times the characteristic impedance thereof. More specifically, if the characteristic of the each of the RF signal lines 1*a* and 1*b* is a general value of 50Ω, the impedance of the resistive element 51 is set to about 1Ω or more.

Since the impedance of the resistive element 51 is determined as described above, the resistive element 51 is not matched with the RF signal lines 1*a* and 1*b*, thereby suppressing an RF signal RF from leaking out into the first control signal line 4.

The resistive element 51 can be formed by using, e.g., a method of forming a thin-film resistive element by vacuum deposition or sputtering, a method of applying the n or $n^+$semiconductor layer, or the like.

If the filter 20, 30, or 40 shown in FIG. 3A, 4A, or 5A is added to the micromachine switch in order to prevent an RF signal RF from leaking out into the first control signal line 4, the entire micromachine switch increases in size. However, by using the resistive element 51 shown in FIGS. 6A and 6B, the objects described above can be achieved without increasing the whole size.

Figure 7A:
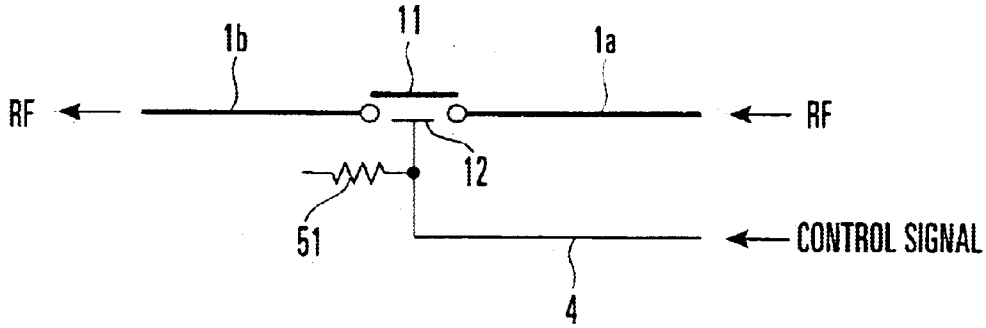
FIG. 7A is a circuit diagram of the fifth arrangement of the first RF signal inhibiting means.
Figure 7B:
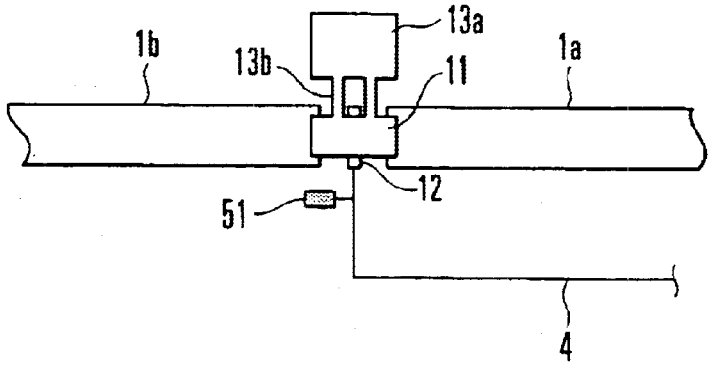
FIG. 7B is a plan view of the fifth arrangement.

Note that as shown in FIGS. 7A and 7B, even if the resistive element 51 is parallelly connected to the first control signal line 4 (i.e., one terminal of the resistive element 51 is connected to the first control signal line 4 and the other terminal is open), resonance can effectively be prevented.

Second Embodiment

Figure 8:
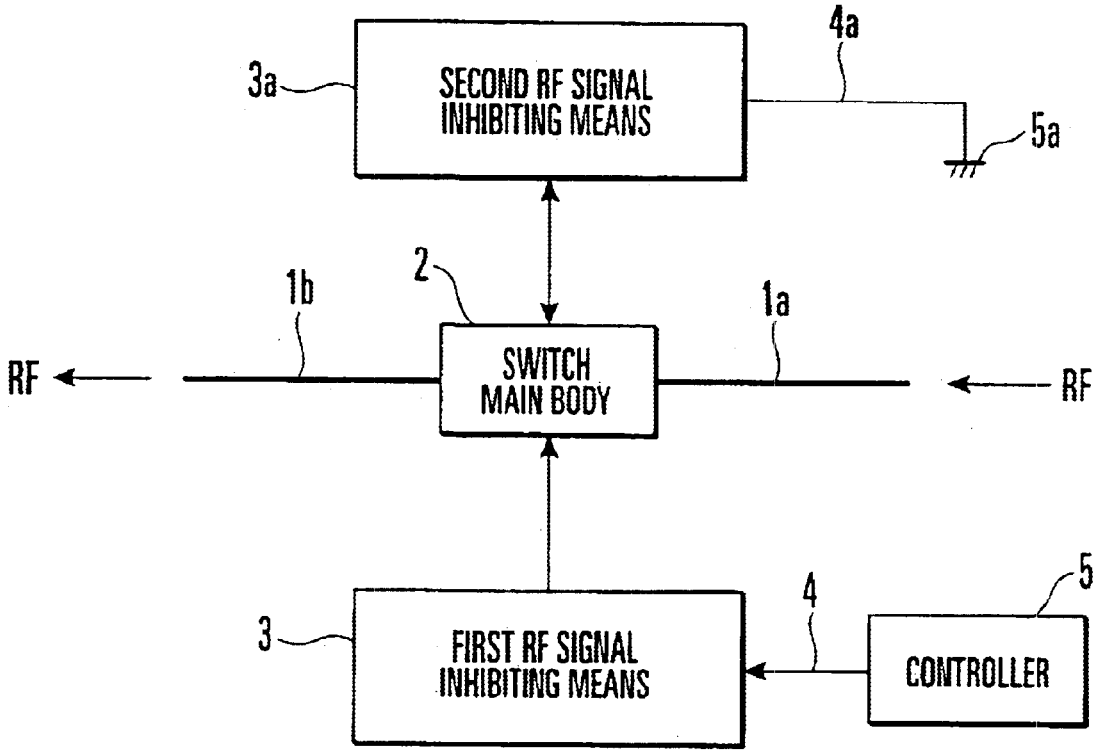
FIG. 8 is a block diagram showing the overall arrangement of a micromachine switch according to the second embodiment of the present invention.
Figure 9A:
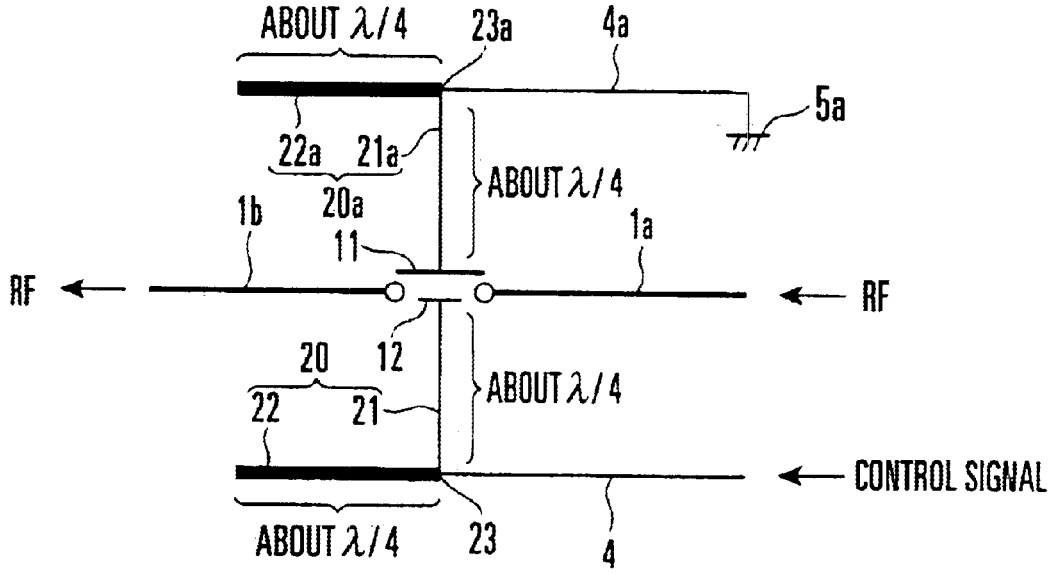
FIG. 9A is a circuit diagram of an arrangement of the micromachine switch shown in FIG. 8.

FIG. 8 is a block diagram showing the overall arrangement of a micromachine switch according to the second embodiment of the present invention. FIG. 9A is a circuit diagram showing an arrangement of the micromachine switch, and FIG. 9B is a plan view of the arrangement.

Figure 9B:
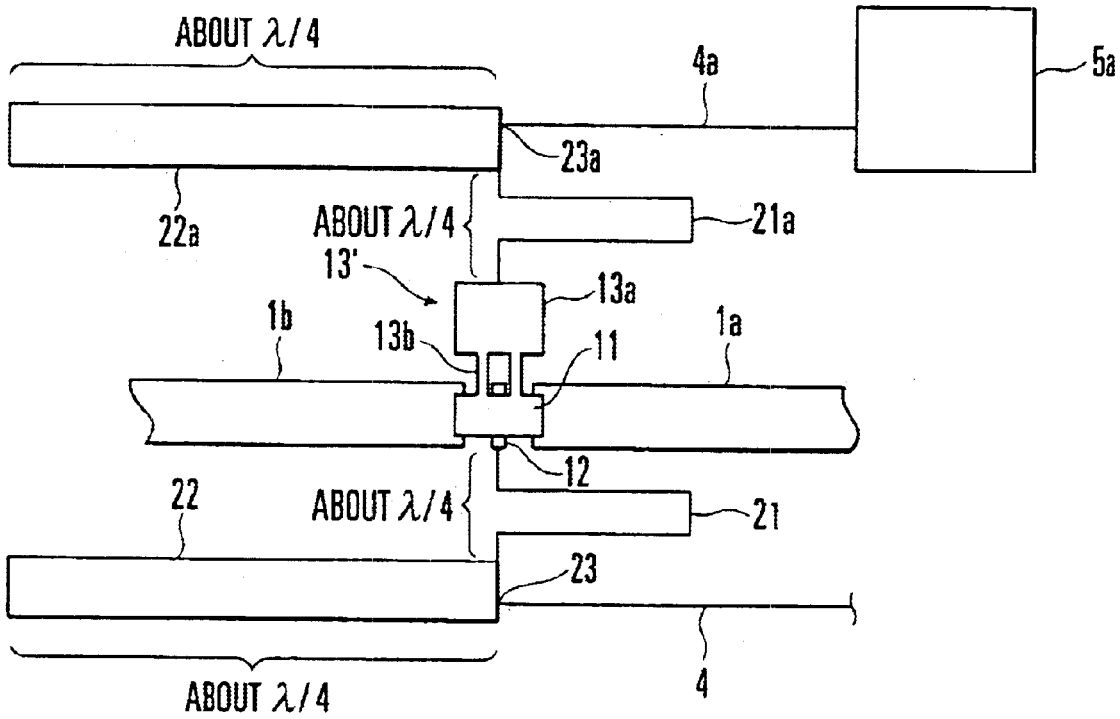
FIG. 9B is a plan view of the arrangement.

The micromachine switch shown in FIGS. 9A and 9B is obtained by grounding a contact 11 of the micromachine switch shown in FIGS. 3A and 3B through a support means 13', a filter 20*a* serving as a second RF signal inhibiting means 3*a*, and a second control signal line 4*a*.

The support means 13' has the same arrangement as the support means 13 shown in FIG. 2 except that it is made of a conductive member, i.e., a conductor or semiconductor.

The filter 20*a* has the same arrangement as the filter 20 shown in FIG. 3A and is constituted by a high-impedance λ/4 line 21*a* and low-impedance λ/4 line 22*a*. One end of the high-impedance λ/4 line 21*a* is connected to the support means 13', and the other end is connected to one end of the low-impedance λ/4 line 22*a*. The other end of the low-impedance λ/4 line 22*a* is open. The other end of the high-impedance λ/4 line 21*a* (i.e., a connecting point 23*a* of the lines 21*a* and 22*a*) is further connected to the second control signal line 4*a* which is connected to ground 5*a*.

Since the contact 11 is grounded in this manner, charges generated by electrostatic induction can be quickly stored in the contact 11 upon starting applying a control signal to a control electrode 12, and the stored charges can be quickly removed upon stopping applying a control signal. Therefore, the switching operation of the micromachine switch can be stabilized, and a switching speed can be increased.

At this time, since the filter 20*a* which inhibits, from passing therethrough, an RF signal RF flowing into RF signal lines 1*a* and 1*b* is connected to the second control signal line 4*a*, no RF signal RF leaks out from the RF signal lines 1*a* and 1*b* into the second control signal line 4*a*. Thus, any problem due to an increase in insertion loss and the degradation of RF characteristic is not posed.

Note that the contact 11 need not be connected to the control signal line 4*a* in a direct-current manner, and a capacitor may be connected between the contact 11 and control signal line 4*a*. In this case, if the capacitor has a sufficient capacitance, the contact 11 is connected to the control signal line 4*a* in a high-frequency manner, thus obtaining the aforementioned charging/discharging effect.

As the second RF signal inhibiting means 3*a*, a filter 30 or 40 shown in FIG. 4A or 5A or a resistive element 51 shown in FIGS. 6A, 6B, 7A, and 7B as well as the filter 20 can be used. Obviously, the arrangement of a first RF signal inhibiting means 3 may be different from that of the second RF signal inhibiting means 3*a*.

Figure 10A:
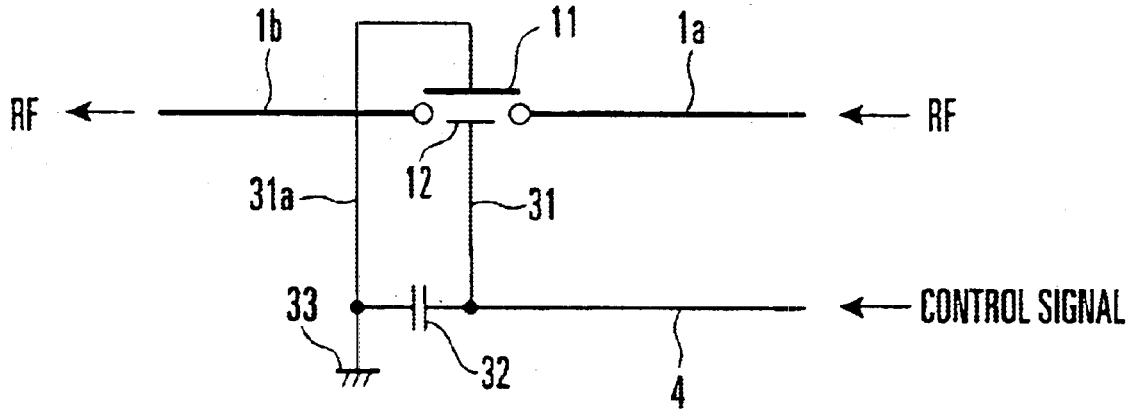
FIG. 10A is a circuit diagram of a micromachine switch in which both first and second RF signal inhibiting means are comprised of the filters shown in FIG. 4.

However, if each of the first and second RF signal inhibiting means 3 and 3*a* is comprised of the filter 30, the arrangements of the first and second RF signal inhibiting means 3 and 3*a* can be simplified. FIG. 10A is a circuit diagram of a micromachine switch when each of the first and second RF signal inhibiting means 3 and 3*a* is comprised of the filter 30, and FIG. 10B is a plan view of the micromachine switch.

Figure 10B:
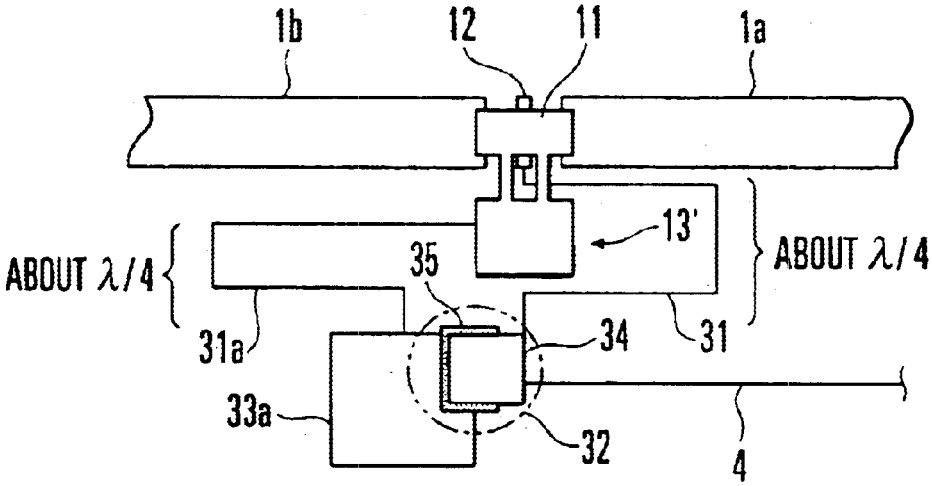
FIG. 10B is a plan view of the micromachine switch.

As shown in FIG. 10B, this micromachine switch can be arranged by only connecting the post of the micromachine switch shown in FIG. 4B to a ground electrode 33*a* through a high-impedance λ/4 line 31*a*. In this arrangement, the high-impedance λ/4 line 31*a* has the same arrangement as the high-impedance λ/4 line 31 which connects the control electrode 12 to an electrode 34.

Referring to FIG. 10A, the first RF signal inhibiting means 3 is constituted by the high-impedance λ/4 line (first high-impedance line) 31, a capacitor 32, and ground 33.

The second RF signal inhibiting means 3*a* is constituted by the high-impedance λ/4 line (second high-impedance line) 31*a*, capacitor 32, and first control signal line 4.

Since the arrangement components are shared by the first and second RF signal inhibiting means 3 and 3*a* in this manner, the micromachine switch can be downsized.

A case in which the present invention is applied to a switch main body 2 with the arrangement shown in FIG. 2 has been described above, but the present invention is characterized in that the RF signal inhibiting means is inserted in a first control signal line 4 or the second control signal line 4*a*, and the switch main body 2 is not limited to have the arrangement shown in FIG. 2. Other arrangements of the switch main body 2 will be described below with reference to FIGS. 11A, 11B, 11C, 11D to 14A, and 14B.

Figure 11A:
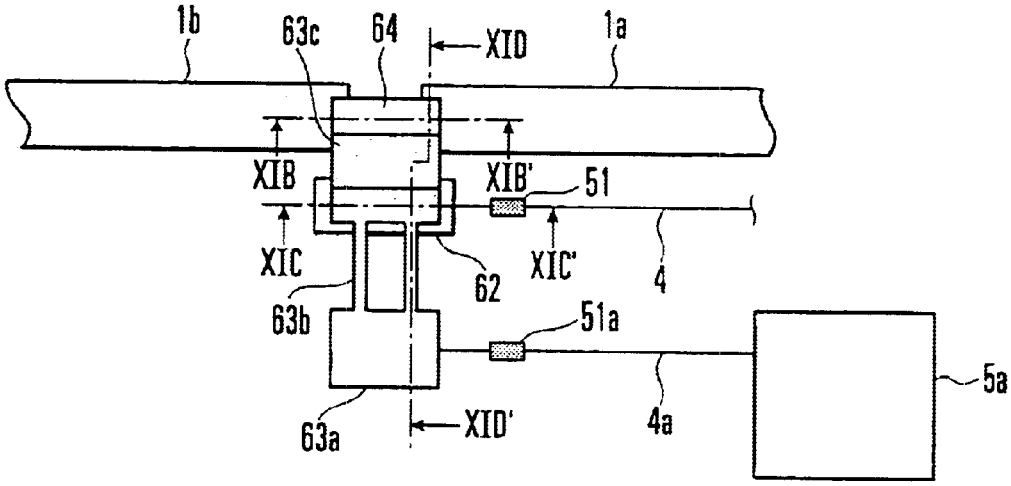
FIG. 11A is a plan view of the second arrangement of a switch main body.

The second arrangement of the switch main body 2 will be described first. FIG. 11A is a plan view of the second arrangement of the switch main body 2, FIG. 11B is a sectional view taken along the line of XIB–XIB' shown in FIG. 11A, FIG. 11C is a sectional view taken along the line XIC–XIC' shown in FIG. 11A, and FIG. 11D is a sectional view taken along the line XID–XID' shown in FIG. 11A.

Figure 11B:
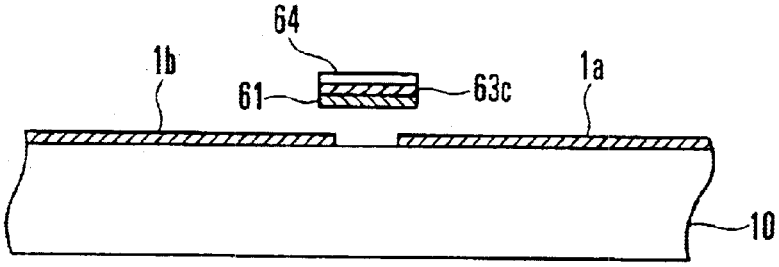
FIG. 11B is a sectional view taken along the line XIB–XIB' shown in FIG. 11A.
Figure 11C:
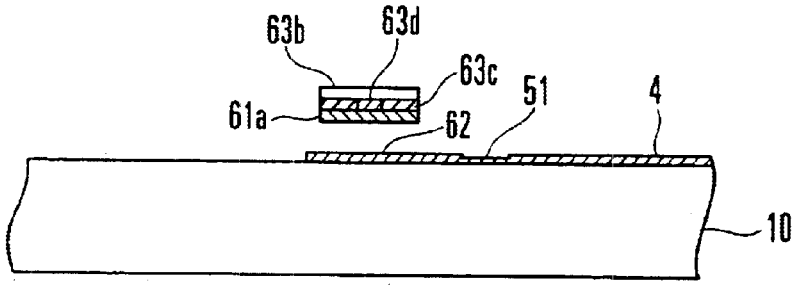
FIG. 11C is a sectional view taken along the line XIC–XIC' shown in FIG. 11A.

As shown in FIGS. 11A and 11B, the RF signal lines 1*a* and 1*b* are formed on a substrate 10 at a small gap.

A contact 61 is supported by a support means above the gap between the RF signal lines 1*a* and 1*b* so as to freely contact the RF signal lines 1*a* and 1*b*.

Figure 11D:
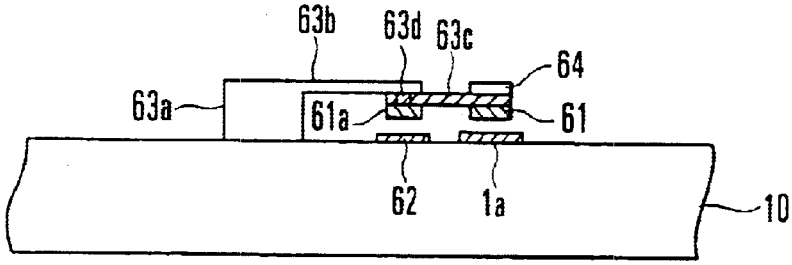
FIG. 11D is a sectional view taken along the line XID–XID' shown in FIG. 11A.

As shown in FIG. 11D, the support means is constituted by a post 63*a*, arm 63*b*, and insulating member 63*c*. The post 63*a* is formed on the substrate 10 to be spaced apart from the RF signal lines 1*a* and 1*b*. The arm 63*b* extends from the upper portion of the side surface of the post 63*a* to a space above a lower electrode 62 (to be described later). The proximal portion of the insulating member 63*c* is fixed to the lower surface of the distal end portion of the arm 63*b*. The insulating member 63*c* extends from the lower surface of the distal end portion of the arm 63*b* to the space above the gap between the RF signal lines 1*a* and 1*b*, and the contact 61 is attached to the lower surface of the distal end portion of the insulating member 63*c*. A reinforcing member 64 is attached to the upper surface of the distal end portion of the insulating member 63*c*.

The lower electrode 62 is formed between the post 63*a* and the gap between the RF signal lines 1*a* and 1*b* (i.e., to be spaced apart from both the RF signal lines 1*a* and 1*b* and the gap therebetween) on the substrate 10. An upper electrode 61*a* is attached to the lower surface of the proximal portion of the insulating member 63*c* so as to oppose the lower electrode 62 apart from each other. The thickness of each of the upper and lower electrodes 61*a* and 62 is set such that the upper and lower electrodes 61*a* and 62 are not brought into contact with each other even when the contact 61 is brought into contact with the RF signal lines 1*a* and 1*b*.

The switch main body 2 shown in FIGS. 11A to 11D is constituted by the contact 61, support means, reinforcing member 64, lower electrode 62, and upper electrode 61*a*.

The first control signal line 4 for applying a control signal is connected to the lower electrode 62, and the first RF signal inhibiting means 3 which inhibits an RF signal RF from passing therethrough is connected to the first control signal line 4. The resistive element 51 is exemplified in FIG. 11A as the first RF signal inhibiting means 3, but the filter 20, 30, or 40 can be used as the first RF signal inhibiting means 3.

In this arrangement, when a voltage is applied to the lower electrode 62 as a control signal, an attraction force is generated between the lower and upper electrodes 62 and 61*a* as in the principle shown in FIG. 2, thereby attracting the upper electrode 61*a* toward the lower electrode 62.

The contact 61 is displaced in interlocking with the upper electrode 61*a* because it is connected to the upper electrode 61*a* by the insulating member 63*c*. When the contact 61 is brought into contact with the RF signal lines 1*a* and 1*b*, the RF signal lines 1*a* and 1*b* are connected in a high-frequency manner.

On the other hand, when stopping applying the voltage to the lower electrode 62, since the attraction force between the upper and lower electrodes 61 and 61*a* disappears, the upper electrode 61*a* returns to the home position. In interlocking with this, the contact 61 also returns to the home position, and the RF signal lines 1*a* and 1*b* are thus released.

Since the displacement of the contact 61 is controlled by the operation of the upper electrode 61*a* when applying a control signal to the lower electrode 62, the upper and lower electrodes 61*a* and 62 function as a driving means for the contact 61.

The second control signal line 4*a* is connected to the post 63*a*, as shown in FIG. 11A, and charges which appear on the upper electrode 61*a* by electrostatic induction when applying a control signal to the lower electrode 62 may be stored/removed through the second control signal line 4*a*.

At this time, the post 63*a* and arm 63*b* must be conductive, and the upper electrode 61*a* must be electrically connected to the arm 63*b*. More specifically, the upper electrode 61*a* and arm 63*b* can be electrically connected by forming a contact 63*d* between the upper electrode 61*a* and arm 63*b*, as shown in FIGS. 11C and 11D, or arranging the upper electrode 61*a* on the upper surface of the distal end portion of the arm 63*b*.

The second RF signal inhibiting means 3*a* is connected to the second control signal line 4*a*. As the second RF signal inhibiting means 3*a*, the filter 20*a*, a filter 30*a*, or a filter 40*a* as well as an exemplified resistive element 51*a* can be used.

Note that a control signal is applied to the lower electrode 62 in FIGS. 11A to 11D, but the control signal may be applied to the upper electrode 61*a*. In this case, the first control signal line 4 is connected to the post 63*a*. The post 63*a* and arm 63*b* must be conductive, and the upper electrode 61*a* must be electrically connected to the arm 63*b*. At this time, the second control signal line 4*a* which stores/removes charges appearing on the lower electrode 62 by electrostatic induction may be connected to the lower electrode 62.

Figure 12A:
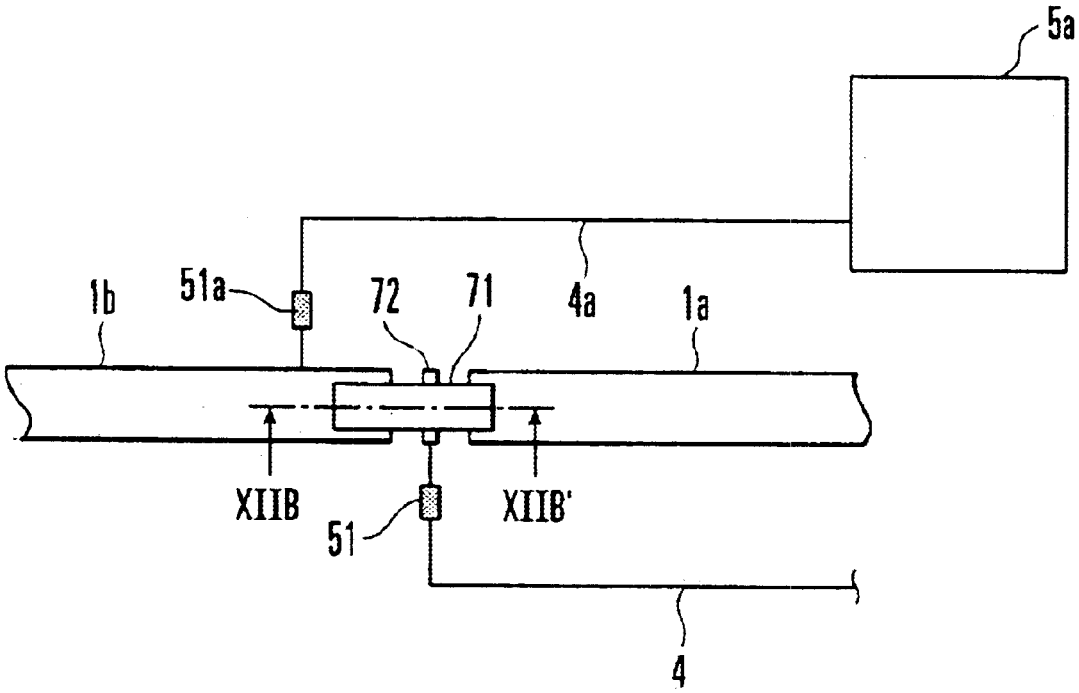
FIG. 12A is a plan view showing the third arrangement of the switch main body.

The third arrangement of the switch main body 2 will be described next. FIG. 12A is a plan view of the third arrangement of the switch main body 2, FIG. 12B is a sectional view taken along the line of XIIB–XIIB' shown in FIG. 12A.

Figure 12B:
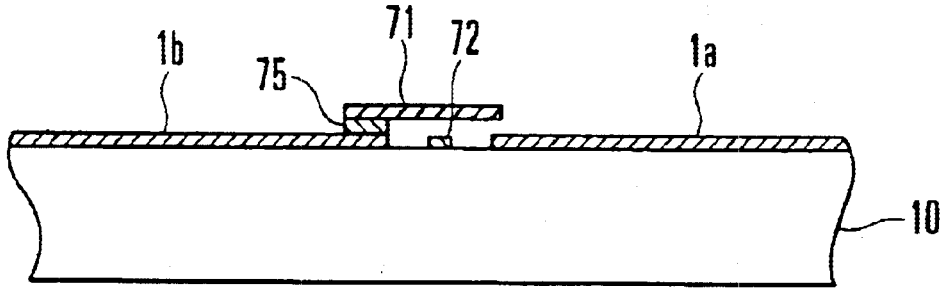
FIG. 12B is a sectional view taken along the line XIIB–XIIB' shown in FIG. 12A.

As shown in FIGS. 12A and 12B, the RF signal lines 1*a* and 1*b* are formed on a substrate 10 at a small gap.

A post 75 made of a conductive member is formed on the end portion of the RF signal line 1*b*. The proximal portion of a contact 71 also made of a conductive member is fixed to the upper surface of the post 75. The contact 71 extends from the upper surface of the post 75 to a space above the end portion of the RF signal line 1*a*.

A control electrode (driving electrode) 72 is formed at a gap between the RF signal lines 1*a* and 1*b* on the substrate 10, i.e., at a position immediately under the contact 71.

The switch main body 2 shown in FIGS. 12A and 12B is constituted by the post 75, contact 71, and control electrode 72.

The first control signal line 4 for applying a control signal is connected to the control electrode 72, and the first RF signal inhibiting means 3 which inhibits an RF signal RF from passing therethrough is connected to the first control signal line 4. Referring to FIG. 12A, the resistive element 51 is exemplified as the first RF signal inhibiting means 3, but the filter 20, 30, or 40 can be used as the first RF signal inhibiting means 3.

The second control signal line 4*a* is connected to the RF signal line 1*b*, as shown in FIG. 12A, and charges which appear on the contact 71 by electrostatic induction when applying a control signal to the control electrode 72 may be stored/removed through the second control signal line 4*a*. At this time, the second RF signal inhibiting means 3*a* is connected to the second control signal line 4*a*. As the second RF signal inhibiting means 3*a*, the filter 20*a*, filter 30*a*, or filter 40*a* as well as the exemplified resistive element 51*a* can be used.

In this arrangement, when a voltage is applied to the control electrode 72 as a control signal, an attraction force is generated between the control electrode 72 and contact 71 as in the principle shown in FIG. 2. This attraction force makes the contact 71 curve toward the substrate 10, and the distal end of the contact 71 is brought into contact with the end portion of the RF signal line 1*a*, thereby connecting the RF signal lines 1*a* and 1*b* to each other in a high-frequency manner.

On the other hand, when stopping applying the voltage to the control electrode 72, since the attraction force disappears, the contact 71 returns to the home position. Thus, the RF signal lines 1*a* and 1*b* are released.

The arrangement shown in FIGS. 12A and 12B does not require a contact supporting means with a complicated shape as shown in FIG. 2 or 11D. This can simplify the arrangements of the micromachine switch.

Figure 13A:
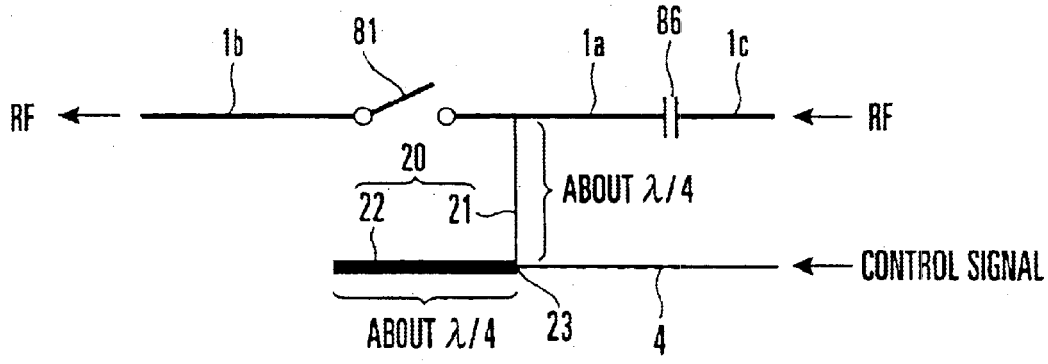
FIG. 13A is a circuit diagram showing a form of the fourth arrangement of the switch main body.

The fourth arrangement of the switch main body 2 will be described. FIG. 13A is a circuit diagram of a form of the fourth arrangement of the switch main body 2, FIG. 13B is a plan view of the fourth arrangement, and FIG. 13C is a sectional view taken along the line XIIIC–XIIIC' shown in FIG. 13B.

Figure 13B:
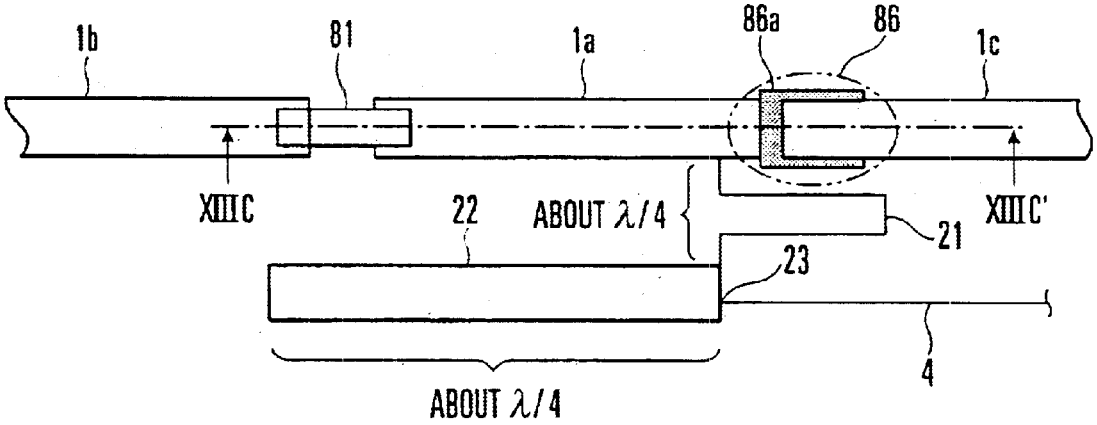
FIG. 13B is a plan view of the switch main body.
Figure 13C:
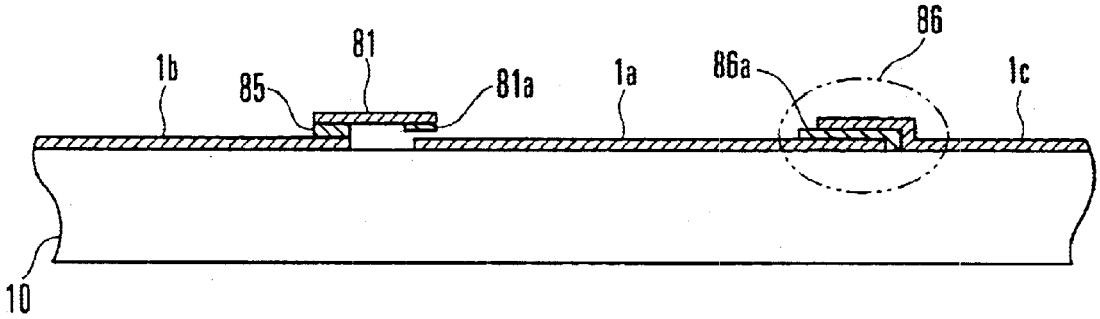
FIG. 13C is a section al view taken along the line XIIIC–XIIIC' shown in FIG. 13B.

As shown in FIG. 13C, the RF signal lines 1*a* and 1*b* and an RF signal line 1*c* are formed on the substrate 10. One end of the RF signal line 1*a* is spaced apart from the RF signal line 1*b* by a small gap, and the other end of the RF signal line 1*a* is connected to the RF signal line 1*c* through a capacitor 86. The capacitor 86 is arranged by interposing an insulating film 86*a* between the RF signal lines 1*a* and 1*c*.

A post 85 made of a conductive member is formed on the end portion of the RF signal line 1*b*. The proximal portion of a contact 81 also made of a conductive member is fixed to the upper surface of the post 85. The contact 81 extends from the upper surface of the post 85 to a space above one end of the RF signal line 1*a*. An insulating film 81*a* is formed on the lower surface of the distal end portion of the contact 81.

The switch main body 2 shown in FIGS. 13A to 13C is constituted by the post 85, contact 81, insulating film 81*a*, and capacitor 86.

The first control signal line 4 for applying a control signal is connected to the RF signal line 1*a* through the first RF signal inhibiting means 3 which inhibits an RF signal RF from passing therethrough. As the first RF signal inhibiting means 3, the filter 20 is exemplified in FIGS. 13A and 13B, but the filter 30 or 40, or resistive element 51 can be used as the first RF signal inhibiting means 3.

In this arrangement, when a voltage is applied to the RF signal line 1*a* as a control signal, an attraction force is generated at an opposing portion of the RF signal line 1*a* and contact 81 as in the principle shown in FIG. 2. When this attraction force makes the contact 81 curve toward the substrate 10, and the insulating film on the distal end portion of the contact 81 is brought into contact with the RF signal line 1*a*, the RF signal lines 1*a* and 1*b* are connected to each other by capacitive coupling in a high-frequency manner.

At this time, since the RF between the RF signal lines 1*c* and 1*a* is also short-circuited, the RF signal lines 1*a* to 1*c* are connected to each other in a high-frequency manner.

Note that the RF signal line 1*a* is insulated from the RF signal lines 1*b* and 1*c* for a direct current and low frequency by the insulating films 81*a* and 86*a*, so that a control signal applied to the RF signal line 1*a* does not leak out into the RF signal lines 1*b* and 1*c*.

On the other hand, when stopping applying the voltage to the RF signal line 1*a*, since the attraction force disappears, the contact 81 and insulating film 81*a* return to the home position. Thus, the RF signal lines 1*a* and 1*b* are released.

Since the displacement of the contact 81 and insulating film 81*a* is controlled depending on whether a voltage is applied to the RF signal line 1*a*, as described above, the RF signal line 1*a* also has a function as a driving means for the contact 81.

Similar to the arrangement shown in FIGS. 12A and 12B, the arrangement shown in FIGS. 13A to 13C does not require a contact supporting means with a complicated shape. This can simplify the arrangement of the micromachine switch.

Note that, in FIG. 13C, the portion of the contact 81 on the RF signal line 1*b* side is fixed. However, the portion of the contact 81 on the RF signal line 1*a* side may be fixed.

Figure 14A:
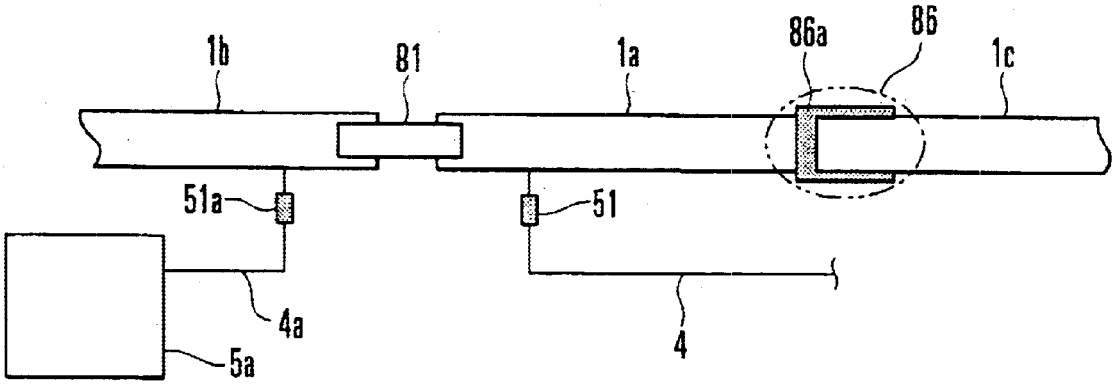
FIGS. 14A and 14B are plan views each showing another form of the fourth arrangement of the switch main body.
Figure 14B:
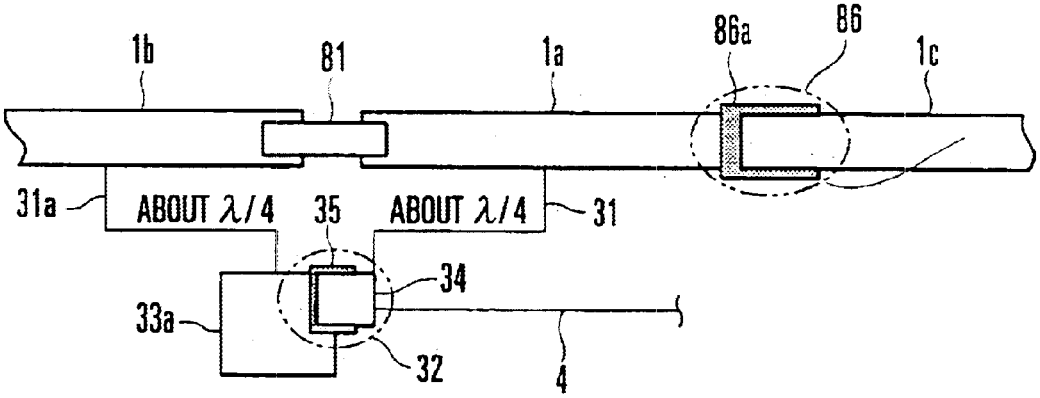

The second control signal line 4*a* is connected to the RF signal line 1*b*, as shown in FIG. 14A, and charges which appear on the contact 81 by electrostatic induction when applying a control signal to the RF signal line 1*a* may be stored/removed through the second control signal line 4*a*. At this time, the second RF signal inhibiting means 3*a* is connected to the second control signal line 4*a*. As the second RF signal inhibiting means 3*a*, the filter 20*a*, 30*a*, or 40*a* as well as the exemplified resistive element 51*a* can be used. In addition, the first and second RF signal inhibiting means 3 and 3*a* may be arranged as shown in FIG. 14B.

In the micromachine switch according to the present invention, an overall arrangement may be formed on the substrate 10. Alternatively, the micromachine switch may be formed by forming a part of the arrangement on a chip and mounting the chip on the substrate 10.

In this case, chip formation is a process in which a number of unit circuits are simultaneously formed on another substrate by a semiconductor process or the like, each of the unit circuits is then cut from the substrate, and the cut circuits are processed to be mounted on the substrate 10.

Figure 15:
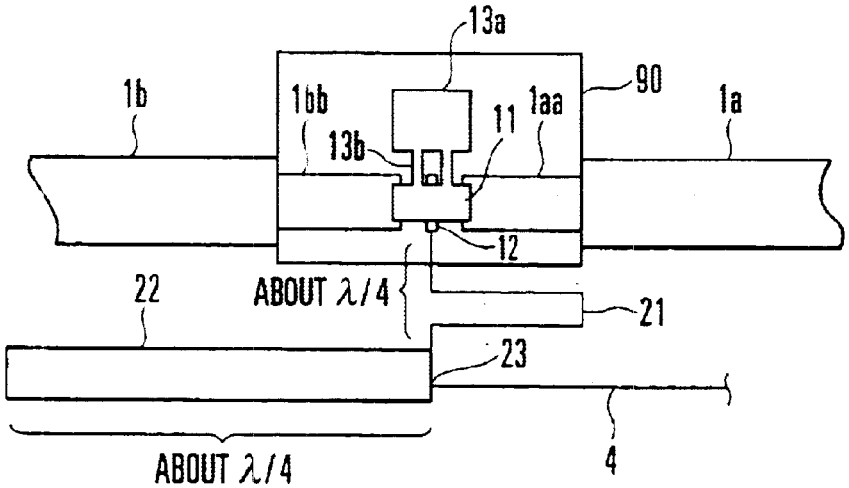
FIG. 15 is a plan view when the micromachine switch shown in FIG. 3B is formed by mounting a switch main body formed on a chip on a substrate.
Figure 16:
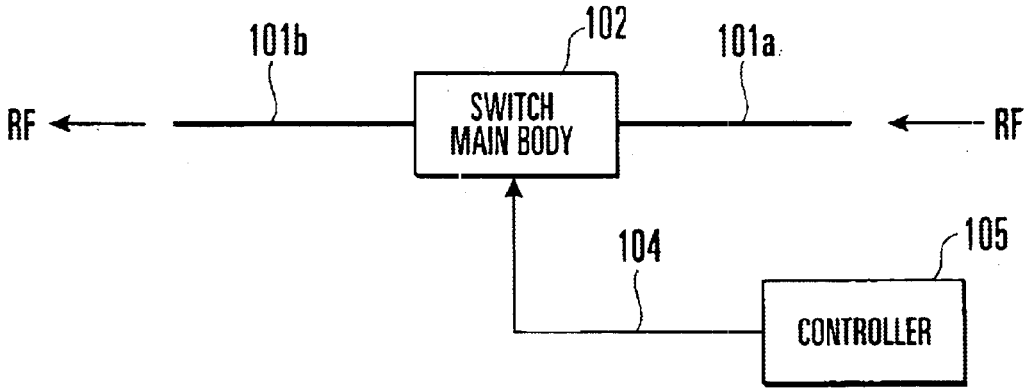
FIG. 16 PRIOR ART
FIG. 16 is a block diagram showing the overall arrangement of a conventional micromachine switch.
Figure 17:
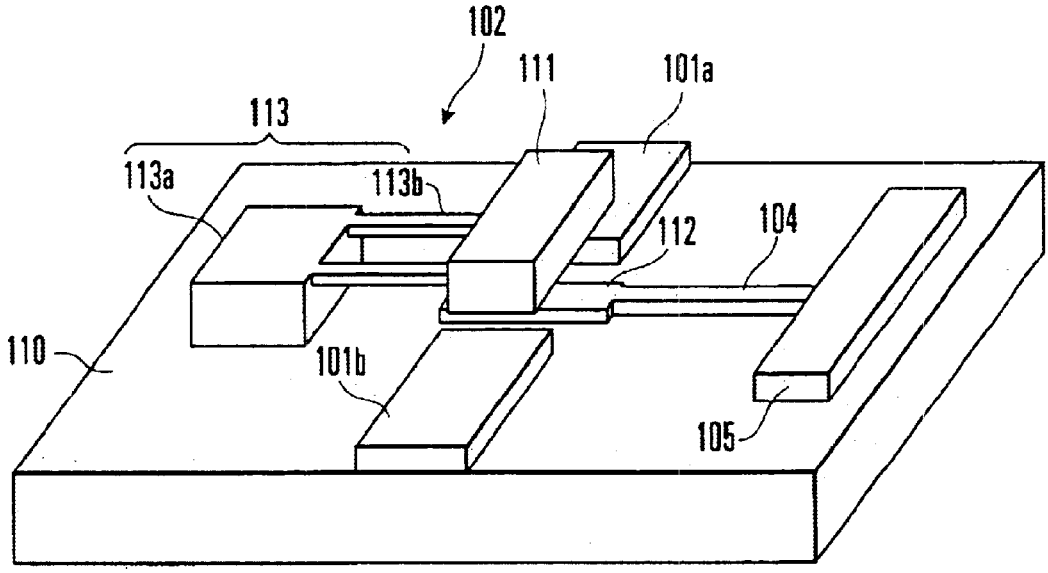
FIG. 17 PRIOR ART
FIG. 17 is a perspective view showing the arrangement of a switch main body shown in FIG. 16.

FIG. 15 is a plan view when the micromachine switch shown in FIG. 3B is formed by mounting the switch main body 2 formed on a chip on the substrate 10.

End portions 1*aa* and 1*bb* of the RF signal lines 1*a* and 1*b* which are fixed contacts of a switch are formed on a chip 90 together with the switch main body 2.

On the other hand, the portion of each of the RF signal lines 1*a* and 1*b* except for the end portion, a high-impedance λ/4 line 21, a low-impedance λ/4 line 22, and the first control signal line 4 are wired on the substrate 10.

By mounting the chip 90 on the substrate 10, the present invention can realize the function as in the micromachine switch shown in FIG. 32.

In addition, defect inspection can be executed to the single chip 90, thus improving a yield of the entire circuit using the micromachine switch.

Industrial Applicability

The micromachine switch according to the present invention is suitable for a switch device for RF circuits such as a phase shifter and frequency variable filter used in a milliwave band to microwave band. However, as the principle, the present invention can be applied to a switch device for RF circuits used in a MHz band.

What is claimed is:

1. A micromachine switch formed on a substrate to switch connection states of two RF signal lines by displacing a contact, characterized by comprising:

driving means for displacing the contact on the basis of a control signal;

a first control signal line for applying the control signal to said driving means; and a first RF signal inhibiting means connected to said first control signal line to inhibit, from passing therethrough, an RF signal flowing into the RF signal lines, characterized in that:

said first RF signal inhibiting means is constituted by a high-impedance line having one end connected to said driving means, a line length of about ¼ a wavelength of the RF signal, and a characteristic impedance higher than a characteristic impedance of each of the RF signal lines, and a low-impedance line having one end connected to the other end of the high-impedance line, the other end which is open, a line length of about ¼ the wavelength of the RF signal, and a characteristic impedance lower than the characteristic impedance of the high-impedance line; and said first control signal line is connected to the other end of the high-impedance line.

2. A micromachine switch formed on a substrate to switch connection states of two RF signal lines by displacing a contact, characterized by comprising:

driving means for displacing the contact on the basis of a control signal;

a first control signal line for applying the control signal to said driving means; and a first RF signal inhibiting means connected to said first control signal line to inhibit, from passing therethrough, an RF signal flowing into the RF signal lines, characterized in that:

said first RF signal inhibiting means is constituted by a high-impedance line having one end connected to said driving means, a line length of about ¼ a wavelength of the RF signal, and a characteristic impedance higher than a characteristic impedance of each of the RF signal lines, and a capacitor having one electrode connected to the other end of the high-impedance line and the other electrode connected to ground; and said first control signal line is connected to the other end of the high-impedance line.

3. A micromachine switch formed on a substrate to switch connection states of two RF signal lines by displacing a contact, characterized by comprising:

driving means for displacing the contact on the basis of a control signal;

a first control signal line for applying the control signal to said driving means; and a first RF signal inhibiting means connected to said first control signal line to inhibit, from passing therethrough, an RF signal flowing into the RF signal lines, characterized in that said first RF signal inhibiting means comprises a resistive element having an impedance much higher than a characteristic impedance of each of the RF signal lines.

4. A micromachine switch according to claim 3, characterized in that the resistive element is serially inserted into said first control signal line.

5. A micromachine switch according to clam 3, characterized in that one terminal of the resistive element is connected to said first control signal line, and the other terminal is open.

6. A micromachine switch formed on a substrate to switch connection states of two RF signal lines by displacing a contact, characterized by comprising:

support means for supporting the contact;

driving means for displacing the contact on the basis of a control signal;

a first control signal line for applying the control signal to said driving means; and a first RF signal inhibiting means connected to said first control signal line to inhibit, from passing therethrough, an RF signal flowing into the RF signal lines, characterized in that said support means has conductivity, and said switch comprises a second control signal line for storing, through said support means, charges which appear on the contact by electrostatic induction upon starting applying the control signal to the control electrode, and removing the charges from the contact through said support means upon stopping applying the control signal to the control electrode, and second RF signal inhibiting means connected to the second control signal line to inhibit, from passing therethrough, the RF signal flowing into the RF signal lines, said driving means comprises a control electrode arranged immediately under the contact between the RF signal lines, characterized in that said support means has conductivity, and said switch comprises a second control signal line for storing, through said support means, charges which appear on the contact by electrostatic induction upon starting applying the control signal to the control electrode, and removing the charges from the contact through said support means upon stopping applying the control signal to the control electrode, and second RF signal inhibiting means connected to the second control signal line to inhibit, from passing therethrough, the RF signal flowing into the RF signal lines.

7. A micromachine switch according to claim 6, characterized in that:

said second RF signal inhibiting means is constituted by a high-impedance line having one end connected to said support means, a line length of about ¼ a wavelength of the RF signal, and a characteristic impedance higher than a characteristic impedance of each of the RF signal lines, and a low-impedance line having one end connected to the other end of the high-impedance line, the other end which is open, a line length of about ¼ the wavelength of the RF signal, and a characteristic impedance lower than the characteristic impedance of the high-impedance line; and said second control signal line is connected to the other end of the high-impedance line.

8. A micromachine switch according to claim 6, characterized in that:

said second RF signal inhibiting means is constituted by a high-impedance line having one end connected to said support means, a line length of about ¼ a wavelength of the RF signal, and a characteristic impedance higher than a characteristic impedance of each of the RF signal lines, and a capacitor having one electrode connected to the other end of the high-impedance line and the other electrode connected to ground; and said second control signal line is connected to the other end of the high-impedance line.

9. A micromachine switch according to claim 6, characterized in that:

said first and second RF signal inhibiting means are constituted by a first high-impedance line having one end connected to said driving means, a line length of about ¼ a wavelength of the RF signal, and a characteristic impedance higher than a characteristic impedance of each of the RF signal lines, a second high-impedance line having one end connected to said support means, a line length of about ¼ the wavelength of the RF signal, and a characteristic impedance higher than a characteristic impedance of each of the RF signal lines, and a capacitor having one electrode connected to the other end of the first high-impedance line and the other electrode connected to the other end of the second high-impedance line;

the other end of the first high-impedance line is connected to said first control signal line; and the other end of the second high-impedance line is connected to ground.

10. A micromachine switch according to claim 6, characterized in that said second RF signal inhibiting means comprises an inductance element.

11. A micromachine switch according to claim 6, characterized in that said second RF signal inhibiting means comprises a resistive element having an impedance much higher than a characteristic impedance of each of the RF signal lines.

12. A micromachine switch according to claim 11, characterized in that the resistive element is serially inserted into said second control signal line.

13. A micromachine switch according to claim 11, characterized in that one terminal of the resistive element is connected to said second control signal line, and the other terminal is open.

14. A micromachine switch formed on a substrate to switch connection states of two RF signal lines by displacing a contact, characterized by comprising:

support means for supporting the contact;

driving means for displacing the contact on the basis of a control signal;

a first control signal line for applying the control signal to said driving means; and a first RF signal inhibiting means connected to said first control signal line to inhibit, from passing therethrough, an RF signal flowing into the RF signal lines, characterized in that said driving means comprises a lower electrode arranged at a position spaced apart from each of the RF signal lines and a gap between the RF signal lines, and an upper electrode attached on said support means so as to oppose the lower electrode apart from each other.

15. A micromachine switch according to claim 14, characterized in that the control signal is applied to the lower electrode.

16. A micromachine switch according to claim 15, characterized in that said support means has an insulating portion between the upper electrode and contact, and said switch comprises a second control signal line for storing, through said support means, charges which appear on the upper electrode by electrostatic induction upon starting applying the control signal to the lower electrode, and removing the charges from the upper electrode through said support means upon stopping applying the control signal to the lower electrode, and second RF signal inhibiting means connected to the second control signal line to inhibit, from passing therethrough, the RF signal flowing into the RF signal lines.

17. A micromachine switch according to claim 16, characterized in that:

said second RF signal inhibiting means is constituted by a high-impedance line having one end connected to said support means, a line length of about ¼ a wavelength of the RF signal, and a characteristic impedance higher than a characteristic impedance of each of the RF signal lines, and a low-impedance line having one end connected to the other end of the high-impedance line, the other end which is open, a line length of about ¼ the wavelength of the RF signal, and a characteristic impedance lower than the characteristic impedance of the high-impedance line; and said second control signal line is connected to the other end of the high-impedance line.

18. A micromachine switch according to claim 16, characterized in that:

said second RF signal inhibiting means is constituted by a high-impedance line having one end connected to said support means, a line length of about ¼ a wavelength of the RF signal, and a characteristic impedance higher than a characteristic impedance of each of the RF signal lines, and a capacitor having one electrode connected to the other end of the high-impedance line and the other electrode connected to ground; and said second control signal line is connected to the other end of the high-impedance line.

19. A micromachine switch according to claim 16, characterized in that:

said first and second RF signal inhibiting means are constituted by a first high-impedance line having one end connected to said driving means, a line length of about ¼ a wavelength of the RF signal, and a characteristic impedance higher than a characteristic impedance of each of the RF signal lines, a second high-impedance line having one end connected to said support means, a line length of about ¼ the wavelength of the RF signal, and a characteristic impedance higher than a characteristic impedance of each of the RF signal lines, and a capacitor having one electrode connected to the other end of the first high-impedance line and the other electrode connected to the other end of the second high-impedance line;

the other end of the first high-impedance line is connected to said first control signal line; and the other end of the second high-impedance line is connected to ground.

20. A micromachine switch according to claim 16, characterized in that said second RF signal inhibiting means comprises an inductance element.

21. A micromachine switch according to claim 16, characterized in that said second RF signal inhibiting means comprises a resistive element having an impedance much higher than a characteristic impedance of each of the RF signal lines.

22. A micromachine switch according to claim 21, characterized in that the resistive element is serially inserted into said second control signal line.

23. A micromachine switch according to claim 21, characterized in that one terminal of the resistive element is connected to said second control signal line, and the other terminal is open.

24. A micromachine switch according to claim 14, characterized in that said support means has an insulating portion between the upper electrode and contact, and the control signal is applied to the upper electrode.

25. A micromachine switch according to claim 24, characterized by comprising:

a second control signal line for storing charges which appear on the lower electrode by electrostatic induction upon starting applying the control signal to the upper electrode, and removing the charges from the lower electrode upon stopping applying the control signal to the upper electrode; and second RF signal inhibiting means connected to the second control signal line to inhibit, from passing therethrough, an RF signal flowing into the RF signal lines.

26. A micromachine switch formed on a substrate to switch connection states of two RF signal lines by displacing a contact, characterized by comprising:

a control electrode arranged immediately under the contact between the RF signal lines to displace the contact on the basis of a control signal;

a first control signal line for applying the control signal to said control electrode; and first RF signal inhibiting means connected to said first control signal line to inhibit, from passing therethrough, an RF signal flowing into the RF signal lines, wherein the contact extends from an end portion of one of the RF signal lines to a space above the other of the RF signal lines, characterized by comprising:

a second control signal line for storing, through said one of the RF signal lines, charges which appear on the contact by electrostatic induction upon starting applying the control signal to the control electrode, and removing the charges from the contact through said one of the RF signal lines upon stopping applying the control signal to the control electrode; and second RF signal inhibiting means connected to the second control signal line to inhibit, from passing therethrough, an RF signal flowing into the RF signal lines.

27. A micromachine switch according to claim 26, characterized in that:

said second RF signal inhibiting means is constituted by a high-impedance line having one end connected to said one of the RF signal lines, a line length of about ¼ a wavelength of the RF signal, and a characteristic impedance higher than a characteristic impedance of each of the RF signal lines, and a low-impedance line having one end connected to the other end of the high-impedance line, the other end which is open, a line length of about ¼ the wavelength of the RF signal, and a characteristic impedance lower than the characteristic impedance of the high-impedance line; and said second control signal line is connected to the other end of the high-impedance line.

28. A micromachine switch according to claim 26, characterized in that:

said second RF signal inhibiting means is constituted by a high-impedance line having one end connected to said one of the RF signal lines, a line length of about ¼ a wavelength of the RF signal, and a characteristic impedance higher than a characteristic impedance of each of the RF signal lines, and a capacitor having one electrode connected to the other end of the high-impedance line and the other electrode connected to ground; and said second control signal line is connected to the other end of the high-impedance line.

29. A micromachine switch according to claim 26, characterized in that:

said first and second RF signal inhibiting means are constituted by a first high-impedance line having one end connected to said driving means, a line length of about ¼ a wavelength of the RF signal, and a characteristic impedance higher than a characteristic impedance of each of the RF signal lines, a second high-impedance line having one end connected to said one of the RF signal lines, a line length of about ¼ the wavelength of the RF signal, and a characteristic impedance higher than a characteristic impedance of each of the RF signal lines, and a capacitor having one electrode connected to the other end of the first high-impedance line and the other electrode connected to the other end of the second high-impedance line;

the other end of the first high-impedance line is connected to said first control signal line; and the other end of the second high-impedance line is connected to ground.

30. A micromachine switch according to claim 26, characterized in that said second RF signal inhibiting means comprises an inductance element.

31. A micromachine switch according to claim 26, characterized in that said second RF signal inhibiting means comprises a resistive element having an impedance much higher than a characteristic impedance of each of the RF signal lines.

32. A micromachine switch according to claim 31, characterized in that the resistive element is serially inserted into said second control signal line.

33. A micromachine switch according to claim 31, characterized in that one terminal of the resistive element is connected to said second control signal line, and the other terminal is open.

* * * * *